United States Patent [19]

Maeda et al.

[11] 4,253,645

[45] Mar. 3, 1981

[54] MOLTEN STEEL DROPLET SCATTER REGULATION CYLINDER

[75] Inventors: Kenji Maeda; Yoshiyuki Iwanami; Masaru Fukumoto, all of Muroran, Japan

[73] Assignee: The Japan Steel Works, Ltd., Tokyo, Japan

[21] Appl. No.: 4,545

[22] Filed: Jan. 18, 1979

[30] Foreign Application Priority Data

Feb. 7, 1978 [JP] Japan ..... 53-11967

[51] Int. Cl.[3] ..... C21C 7/10

[52] U.S. Cl. ..... 266/211; 266/280; 266/283; 266/286

[58] Field of Search ..... 266/211, 270, 280, 283, 266/284, 286

[56] References Cited

U.S. PATENT DOCUMENTS 3,061,300 10/1962 Schultz ..... 266/270

*Primary Examiner*—R. Dean

*Attorney, Agent, or Firm*—Larson, Taylor and Hinds

[57] ABSTRACT

In a molten steel droplet scatter regulation cylinder for use in a vacuum steel casting system, for the object of prevention of growth of molten steel droplets into a solid steel block at the lower end portion of the cylinder to subsequently drop into the molten steel, deteriorating its internal properties, the cylinder has at least its lower end portion made of a material which has a small wetting property against the molten steel, e.g. carbides such as graphite, silicon carbide, etc. or refractory materials containing carbon, carbides, etc.

3 Claims, 5 Drawing Figures

MOLTEN STEEL DROPLET SCATTER REGULATION CYLINDER

BACKGROUND OF THE INVENTION

The present invention relates to an apparatus for use in a vacuum steel casting system and more particularly to a regulation cylinder for the prevention of scatter of molten steel droplets which occurs when the molten steel is poured into a mold placed in a vacuum chamber.

It is a well known fact that, in a vacuum steel casting system, when the molten steel is poured into a mold placed within a vacuum chamber through a nozzle provided in the bottom of a vessel which is put on the lid of the vacuum chamber and in which the molter steel is contained, the molten steel scatters thereabout to fall in a state of droplets. Therefore, in order that the droplets be poured into the mold properly it is necessary to mount in the lid a molten steel droplet scatter regulation cylinder directly beneath the nozzle to collect the droplets. In this case the molten steel which flows along the inner wall of the scatter regulation cylinder finally solidifies at the lower end portion of the cylinder due to the temperature drop to adhere there, and the solidified steel grows to a large block as time elapses. However, as the result of the growth, should the block of solidified steel thus grown drop into the molten steel in the mold the internal properties of the steel ingot thus produced deteriorate remarkably whether the drop occurs during the pouring or after the completion of the pouring.

Therefore it has been a matter of utmost concern in the field of art to solve this difficulty inherent to the conventional molten steel droplet scatter regulation cylinders.

SUMMARY OF THE INVENTION

It is an object of the present invention to provide a molten steel droplet scatter regulation cylinder for use in a vacuum steel casting system which can effectively prevent the molten steel from adhering to the lower end portion of the cylinder to grow to solidified steel blocks there.

It is another object of the present invention to provide a molten steel droplet scatter regulation cylinder for use in a vacuum steel casting system which can effectively eliminate all internal defectives found in steel ingots such as abnormal structure, non-metallic inclusion, etc. that are apt to be caused by the fall of the solidified steel blocks adhering to the lower end portion of the cylinder into the molten steel within the mold in which the steel ingot is cast.

It is a still further object of the present invention to provide a molten steel droplet scatter regulation cylinder for use in a vacuum steel casting system which is simple in constitution and also allows a easy application to existing droplet scatter regulation cylinders with simple modification.

In accordance with the present invention, molten steel droplet scatter regulation cylinder principally comprising a substantially conical or cylindrical hollow element made of a refractory material is provided in which at least the lower end portion of the hollow element is constituted from carbides such as graphite, silicon carbide, etc. or refractory materials containing carbon, carbides, etc. which little wet molten steel or have a small wetting property against the molten steel. Thus, it will be appreciated that according to the present invention the stay time of molten steel droplets at the end portion of the droplet scatter regulation cylinder is made small due to the contact of the molten steel droplets with the hollow element at the end portion made of carbides, etc. which little wet the molten steel, resulting in no solidification or growth to a block of the droplets there, so that no deterioration occurs in the internal properties of the steel ingot produced due to such as the dropping of solidified droplets into the molten steel in the mold.

BRIEF DESCRIPTION OF THE DRAWINGS

These and other objects of the present invention will become more readily apparent upon a reading of the following specification and upon reference to the accompanying drawings, in which.

DESCRIPTION OF THE PREFERRED EMBODIMENT

Figure 1:
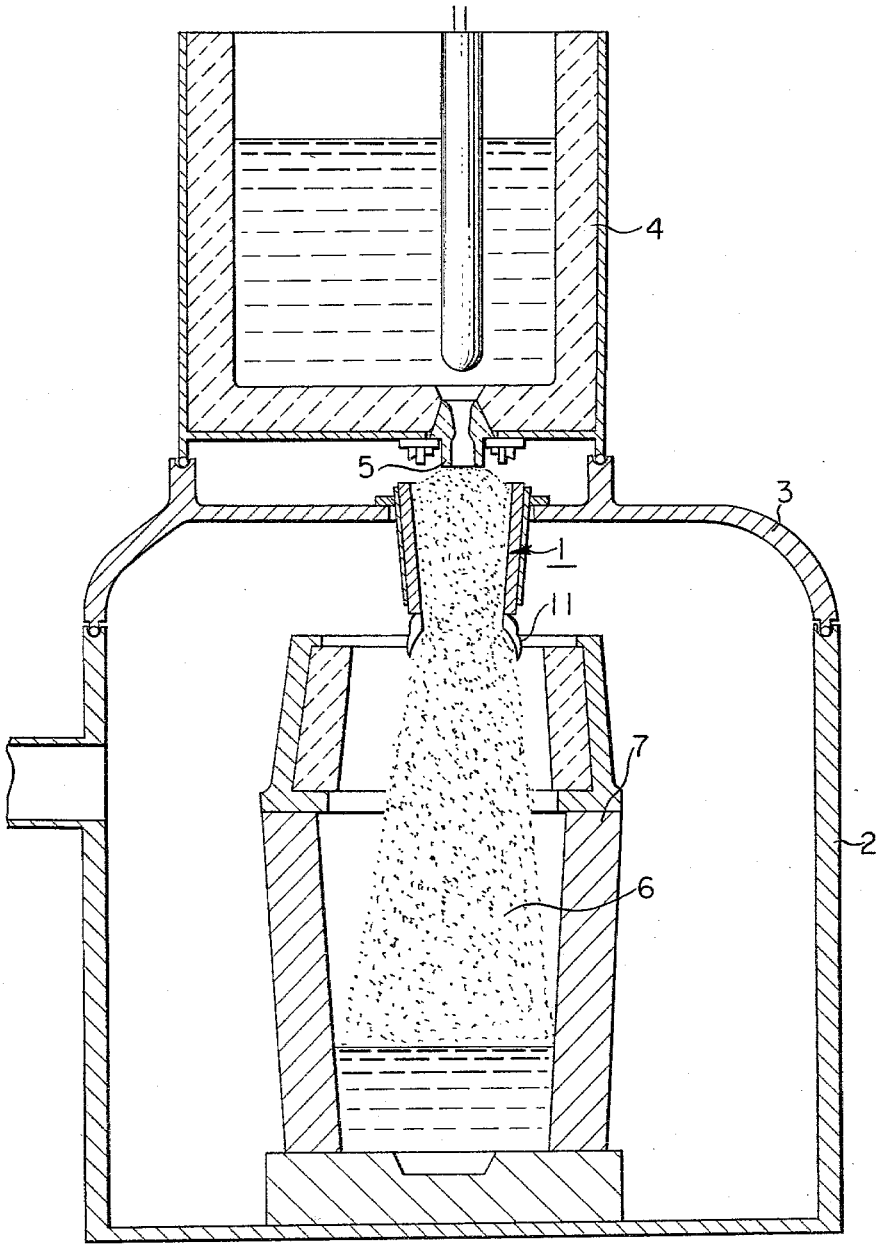
FIG. 1 shows diagrammatically a sectional view of the state of pouring molten steel in a vacuum pouring system from a vessel into a mold located in a vacuum chamber.
Figures 2A, 2B, 2C, 2D, 2E:
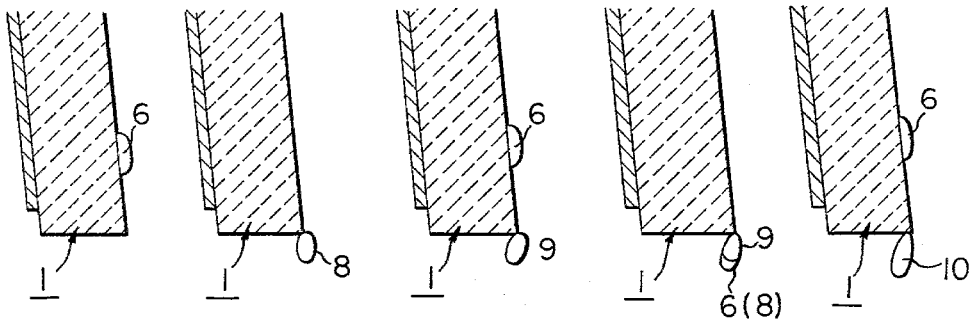
FIG. 2 are basic representations showing how molten steel droplets are formed at the lower end portion of a molten steel droplet scatter regulation cylinder.

Prior to entering into the detailed explanation of the preferred embodiment of the present invention, the phenomena of the growth of solidified steel at the lower end portion in a conventional molten steel scatter regulation cylinder will be qualitatively explained in reference to FIGS. 1 and 2. As shown in FIG. 1, arranged centrally on the lid 3 of a vacuum chamber 2 is a vessel 4 for receiving molten steel which is adapted to be poured into a mold 7 placed in a vacuum chamber 2 through a nozzle 5 provided in the bottom of vessel 4 and a molten steel droplet scatter regulation cylinder 1 mounted to lid 3 beneath nozzle 5, the cylinder 1 functioning to guide or collect molten steel contained in vessel 4 into mold 7 placed within vacuum chamber 2 when the molten steel drops through nozzle 5 in a droplets state. FIG. 2 shows basically the process by which the molten steel adheres to the lower end portion of scatter regulation cylinder 1 shown in FIG. 1 to solidify there. As shown in FIG. 2A a molten steel droplet 6 falling down along the inner wall surface of scatter regulation cylinder 1 remains at its lower end as a droplet 8 as shown in FIG. 2B. The part of the inner wall of cylinder 1 with which molten steel droplets come into contact 6 is generally of a refractory material, and since it has a large wetting property against molten steel droplet 8 i.e. it wets molten steel droplet 8 well, the time period during which molten steel 8 remains there is long so that molten steel droplet 8 solidifies there as the result of its cooling to adhere to the surface of the refractory material as a solidified steel block 9 as shown in FIG. 2C. Further, as shown in FIG. 2D, another molten steel 6 falls down along the inner wall surface of scatter regulation cylinder 1 onto solidified steel 9 to stop at its lower end, and when the stay time is sufficiently long molten steel 6 solidifies together with previously solidified steel 9 to become a larger solid steel block 10 as shown in FIG. 2E. Thus, solidified steel block 10 gradually grows to an even larger solid steel block 11 as shown in FIG. 1. Should this drop into the molten steel, whether during the pouring or after completion of the pouring, there arise defects in the internal properties of the steel ingot produced such as abnormal structure, large non-metallic inclusion, etc. due to the non-fusion of the steel block.

Now a preferred embodiment of the present invention will be explained in reference to FIG. 3, the embodiment being aimed at effectively preventing the molten steel droplet from adhering to the lower end portion of a droplet scatter regulation cylinder and growing to solid steel blocks there.

Figure 3:
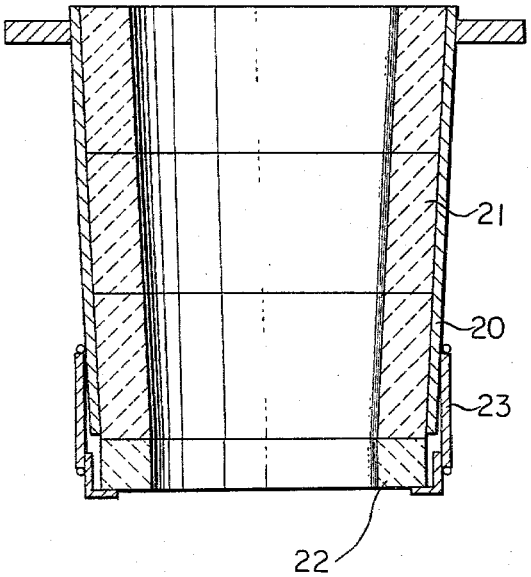
FIG. 3 shows one embodiment of a molten steel droplet scatter regulation cylinder according to the present invention in a longitudinal sectional view.

As shown in FIG. 3, in accordance with the present invention, the molten steel droplet scatter regulation cylinder comprises a hollow conical metal frame 20, one or more refractory rings 21 stacked within metal frame 20 with a hollow conical passage for the molten steel being left centrally axially therein, and a ring 22 made of carbides such as graphite, silicon carbide, etc. or refractory materials containing carbon, carbides, etc., ring 22 being directly secured to the underside of the lowermost refractory ring 21 by any suitable means such as by supporting the underside of ring 22 with a set of metal mountings 23 which are suitably swingably secured at their upper portions to the outer surface of metal frame 20 at its lower portion. Further, ring 22 may be integral as a single piece or separated into several pieces so as to be assembled as a unit when supported on metal mountings 23.

It will be appreciated that the molten steel droplet scatter regulation cylinder thus constituted according to the present invention makes it effectively possible to prevent solid steel blocks from forming at its lower end portion thanks to the provision of ring 22 made of carbides, etc. which do not substantially wet molten steel, letting the molten steel droplet fall before it solidifies or grows. Consequently, the molten steel droplet scatter regulation cylinder in accordance with the present invention can wholly eliminate the occurance of such internal defects found in steel ingots as abnormal structure, large non-metallic inclusion, etc. that have been usual in the case of conventional molten steel droplet scatter regulation cylinders due to the dropping of the solid steel blocks into molds when the molten steel is poured into the molds contained in a vacuum chamber.

Figure 4:
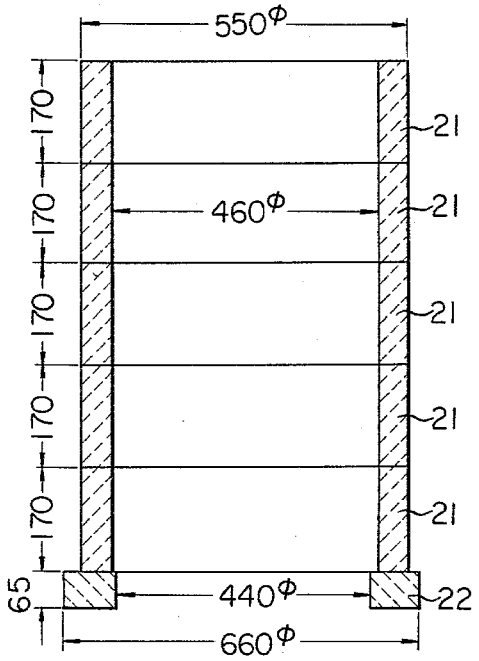
FIGS. 4 and 5 show two examples of the present invention in a longitudinal sectional view.
Figure 5:
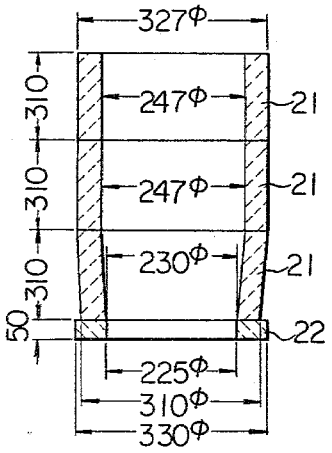

Following are the two examples of the present invention which proved that it could attain its objects as expected. They have respectively such dimensions as shown in FIGS. 4 and 5 in mm, the former being intended for use in pouring an ingot having a weight of about 75 t, the latter that of below 40 t.

In both examples, refractory rings 21 are made of conventional high-alumina material, comprising:

$SiO_2$ 38.28 wt%, $Al_2O_3$ 58.56 wt%, $Fe_2O_3$ 1.42 wt%, whereas ring 22 is made of alumina-carbon material in accordance with the present invention, comprising:

C 20.5 wt%, $Al_2O_3$ 65.2%, SiC 6.0%.

As will be readily apparent to those skilled in the art, the present invention may be realized in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalents of the claims are therefore intended to be embraced therein.

What is claimed is:

1. In a molten steel droplet scatter regulation cylinder for use in a vacuum steel casting system comprising a hollow element made of a high alumina refractory material and means by which said hollow element is mounted on the lid of a vacuum chamber within which is placed a mold into which molten steel is poured, the improvement wherein at least the lower end portion of said hollow element is comprised of a refractory material which does not substantially wet molten steel selected from the group consisting of graphite, silicon carbide, carbon-containing refractory material and a carbide-containing refractory material.

2. A molten steel droplet scatter regulation cylinder as claimed in claim 1 wherein said lower end portion of said hollow element is a single integral piece connected to said hollow element.

3. A molten steel droplet scatter regulation cylinder as claimed in claim 1 wherein said lower end portion of said hollow element is composed of an assembly of several pieces, said assembly being connected to said hollow element.

* * * * *